US010571867B2

(12) United States Patent
Akiyama

(10) Patent No.: US 10,571,867 B2
(45) Date of Patent: Feb. 25, 2020

(54) ELECTRONIC TIMEPIECE

(71) Applicant: Seiko Epson Corporation, Tokyo (JP)

(72) Inventor: Toshikazu Akiyama, Matsumoto (JP)

(73) Assignee: Seiko Epson Corporation (JP)

( * ) Notice: Subject to any disclaimer, the term of this patent is extended or adjusted under 35 U.S.C. 154(b) by 65 days.

(21) Appl. No.: 15/838,851

(22) Filed: Dec. 12, 2017

(65) Prior Publication Data

US 2018/0164750 A1 Jun. 14, 2018

(30) Foreign Application Priority Data

Dec. 13, 2016 (JP) ..... 2016-241311

(51) Int. Cl.
*G04R 20/04* (2013.01)
*G04G 9/08* (2006.01)
*G04G 7/00* (2006.01)

(52) U.S. Cl.
CPC ..... *G04R 20/04* (2013.01); *G04G 7/02* (2013.01); *G04G 9/087* (2013.01)

(58) Field of Classification Search
CPC ..... G04R 20/00; G04R 20/02; G04R 20/04
See application file for complete search history.

(56) References Cited

U.S. PATENT DOCUMENTS 5,329,501 A * 7/1994 Meister ..... G04G 21/04 340/7.53
6,240,366 B1 * 5/2001 Nagatsuma ..... G01S 19/52 342/357.42
7,760,588 B2 * 7/2010 Takada ..... G04R 20/10 368/46
2009/0015470 A1 1/2009 Fujisawa
2009/0079630 A1 3/2009 Baba et al.
2009/0140919 A1 * 6/2009 Shingyoji ..... G01S 19/24 342/357.63
2009/0189809 A1 7/2009 Baba
2017/0357222 A1 * 12/2017 Araki ..... G04R 20/06
2018/0173168 A1 * 6/2018 Hasegawa ..... G04R 20/26

FOREIGN PATENT DOCUMENTS

JP 2009-036748 A 2/2009
JP 2009-180555 A 8/2009
JP 2009-229106 A 10/2009
JP 2010-032556 A 2/2010
JP 2015-132626 A 7/2015

* cited by examiner

*Primary Examiner* — Edwin A. Leon
*Assistant Examiner* — Jason M Collins
(74) *Attorney, Agent, or Firm* — Harness, Dickey & Pierce, P.L.C.

(57) ABSTRACT

An electronic timepiece includes a display section capable of displaying reception state information based on the strength of a received satellite signal or the number of captured satellites during the execution of a reception process. In a case where a predetermined period has elapsed with no acquisition of time information or position information since the reception process started, the reception state information is displayed on the display section, and in a case where the time information or the position information has been successfully acquired within the predetermined period since the reception process started, the reception state information is not displayed on the display section but the reception process is terminated.

15 Claims, 14 Drawing Sheets

CONFIGURATION OF HOW (HAND OVER) WORD

ELECTRONIC TIMEPIECE

BACKGROUND

1. Technical Field

The present invention relates to an electronic timepiece that receives an electric wave.

2. Related Art

Among electronic timepieces of related art each of which receives a satellite signal from a position information satellite, such as a GPS (global positioning system) satellite, there is a timepiece that displays information on the reception state during the reception process (see JP-A-2009-180555, for example).

The electronic timepiece described in JP-A-2009-180555 calculates a reception state level during the reception process at 1-second intervals on the basis, for example, of the number of captured satellites and the signal strength of each of the received signals and displays the calculated reception state level by using the second hand.

However, in the case where the reception state level is unconditionally displayed at the timing when the reception state level is calculated and acquired, as in the electronic timepiece described in JP-A-2009-180555, the following problem, for example, occurs, probably resulting in a decrease in convenience provided by the electronic timepiece.

In general, for several seconds after the reception process starts, the number of captured satellites has not been fixed, and the reception state level has therefore also not been fixed in many cases. The electronic timepiece described in JP-A-2009-180555, which displays the reception state level at 1-second intervals, undesirably displays the reception state level one second after the reception process starts. Incorrect information is therefore displayed, probably resulting in decrease in convenience provided by the electronic timepiece.

SUMMARY

An advantage of some aspects of the invention is to provide an electronic timepiece capable of displaying information on the reception state to improve the convenience provided by the electronic timepiece.

An electronic timepiece according to an aspect of the invention includes a reception device that receives an electric wave, a reception control section that executes a reception process of controlling the reception device to cause the reception device to receive the electric wave and acquiring time information based on a received signal, an acquisition section that acquires reception state information on a reception state of the electric wave, an indicating hand capable of displaying the reception state information and predetermined information set in advance, a display control section that controls display performed by the indicating hand, and an evaluation section that evaluates whether or not a state of the reception process satisfies a preset condition under which the reception state information is displayed, and the display control section causes the indicating hand to display the reception state information when the display condition is satisfied during the execution of the reception process and causes the indicating hand to display the predetermined information when the reception process is completed.

The reception state information is, for example, the number of captured satellites and a reception state level calculated on the basis of the number of captured satellites and the strengths of the signals therefrom. The predetermined information is, for example, a result of reception and time.

According to the aspect of the invention, the reception state information is displayed when the state of the reception process satisfies the preset display condition during the execution of the reception process.

Therefore, for example, in a case where it can be decided that the reception state information is correct, the reception state information can be displayed.

In a case where the reception process is completed in the middle of the indicating hand's action of displaying the reception state information (during movement of indicating hand), stopping the indicating hand in the middle of the movement thereof and displaying the predetermined information makes the display unnatural. To avoid such a situation, the display control section, for example, causes the indicating hand to display the predetermined information after the display control section causes the indicating hand to display the reception state information (after movement of indicating hand is completed). In this case, however, the display of the predetermined information is likely to be delayed as compared with a case where the predetermined information is displayed in a state in which the indicating hand is stationary. According to the aspect of the invention, the electronic timepiece can, for example, be so configured that in a case where it can be decided that the reception state information is incorrect, the reception state information is not displayed, whereby the display of the predetermined information is not delayed due to display of the incorrect reception state information.

According to the aspect of the invention, the convenience provided by the electronic timepiece can thus be improved.

In the electronic timepiece according to the aspect of the invention, it is preferable that the evaluation section determines that the display condition is satisfied when a predetermined period set in advance has elapsed with no acquisition of the time information since the reception process started.

According to the aspect of the invention with this configuration, in a case where time information has been successfully acquired since the reception process started but before the predetermined period elapses, the predetermined information is displayed with no display of the reception state information. In a case where time information has been successfully acquired since the reception process started but after the predetermined period elapsed or in a case where timeout occurs, the predetermined information is displayed after the reception state information is displayed.

According to the aspect of the invention with this configuration, in a case where a certain period has elapsed since the reception process stated, and it can be decided that the reception state information is fixed, the reception state information can be displayed.

Further, in GPS, for example, in which the time information is transmitted at 6-second intervals, the time information can be acquired several seconds after the reception process starts in a satisfactory reception environment. According to the aspect of the invention, the electronic timepiece can be so configured that in the case where the time information can be acquired in a short period as described above, the reception state information is not displayed, whereby the display of the predetermined information is not delayed due to display of the reception state information, and the predetermined information can be quickly displayed.

It is preferable that the electronic timepiece according to the aspect of further includes a success chance evaluation section that evaluates whether or not there is a chance of successful reception based on the state of the reception process, and the evaluation section determines that the display condition has been satisfied when it has been determined that there is no chance of successful reception.

The success chance evaluation section evaluates whether or not there is a chance of successful reception on the basis, for example, of the signal strength of the received electric wave.

In a case where it can be determined that there is no chance of successful reception, it can be decided that the electronic timepiece is in a situation in which a position information satellite is unlikely to be captured, for example, in a situation a position information satellite that provides high signal strength has not been captured. Therefore, in the case where it is determined that there is no chance of successful reception, displaying the reception state information allows notification of the situation in which a position information satellite is unlikely to be captured.

Further, in the case where it is determined that there is no chance of successful reception, in the middle of the display of the reception state information, there is a low possibility of acquisition of the time information, and there is also a low possibility of delay of the display of the predetermined information due to the display of the reception state information.

An electronic timepiece according to another aspect of the invention includes a reception device that receives a satellite signal transmitted from a position information satellite, a reception control section that executes a reception process of controlling the reception device to cause the reception device to receive the satellite signal, calculating position information based on a received signal, and acquiring the position information, an acquisition section that acquires reception state information on a reception state of the satellite signal, a display section capable of displaying the reception state information, a display control section that controls display performed by the display section, and an evaluation section that evaluates whether or not a state of the reception process satisfies a preset condition under which the reception state information is displayed, and the evaluation section determines that the display condition is satisfied when a predetermined period set in advance has elapsed with no acquisition of the position information since the reception process started, and the display control section causes the display section to display the reception state information when the display condition is satisfied during the execution of the reception process.

According to the aspect of the invention, in a case where a certain period has elapsed since the reception process stated, and it can be decided that the reception state information is fixed, the reception state information can be displayed, whereby the convenience provided by the electronic timepiece can be improved.

It is preferable that the electronic timepiece according to the aspect of the invention further includes a condition evaluation section that evaluates whether or not a number of position information satellites captured in the reception process and a signal strength of a signal from each of the captured position information satellites satisfy a position measurable condition set in advance, and the evaluation section determines that the display condition has been satisfied when the position measurable condition has been satisfied.

According to the aspect of the invention with this configuration, even before the predetermined period elapses after the start of the reception process, but in a case where the position measurable condition is satisfied and it can be decided that a successful reception environment is achieved, the reception state information is displayed, whereby the situation in which a successful reception environment has been achieved can be quickly displayed.

It is preferable that the electronic timepiece according to the aspect of the invention further includes a start information displaying indicating hand capable of displaying start information representing that the reception process starts and an operation section, and the reception control section, upon detection of reception start operation performed on the operation section, activates the reception device to start the reception process, that the display control section, upon detection of the reception start operation performed on the operation section, causes the start information displaying indicating hand to display the start information, and that the activation of the reception device and the display of the start information are simultaneously performed.

The simultaneous activation of the reception device and display of the start information is intended to achieve a state in which the period during the activation of the reception device and the period during the movement of the start information displaying indicating hand for display of the start information at least partially overlap with each other.

According to the aspect of the invention with this configuration, the start information can be quickly displayed as compared with a case where the start information displaying indicating hand starts moving after the activation of the reception device is completed. Further, the average period from the point of time when the reception start operation is performed to the point of time when the reception process is completed can be shortened as compared with a case where the activation of the reception device starts after the movement of the start information displaying indicating hand is completed.

It is preferable that the electronic timepiece according to the aspect of the invention further includes a reception result displaying indicating hand capable of displaying a result of the reception, a time displaying indicating hand capable of displaying time, and a time correction section that corrects the time based on information acquired in the reception process, and the display control section controls the reception result displaying indicating hand and the time displaying indicating hand to cause the indicating hands to simultaneously display the result of the reception and the corrected time in a case where the information has been successfully acquired in the reception process.

The state in which the result of the reception and the corrected time are simultaneously displayed is a state in which the period for which the reception result displaying indicating hand moves to display the result of the reception and the period for which the time displaying indicating hand moves to display the corrected time at least partially overlap with each other.

According to the aspect of the invention with this configuration, the period before a user can check both the result of the reception and the corrected time can be shortened as compared with a case where either the result of the reception or the corrected time is displayed and then the other is displayed.

In the electronic timepiece according to the aspect of the invention, it is preferable that the reception result displaying indicating hand is a longest indicating hand of the indicating hands provided in the electronic timepiece.

According to the aspect of the invention with this configuration, a result of the reception can be displayed in an easy-to-understand manner.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

Figure 1:
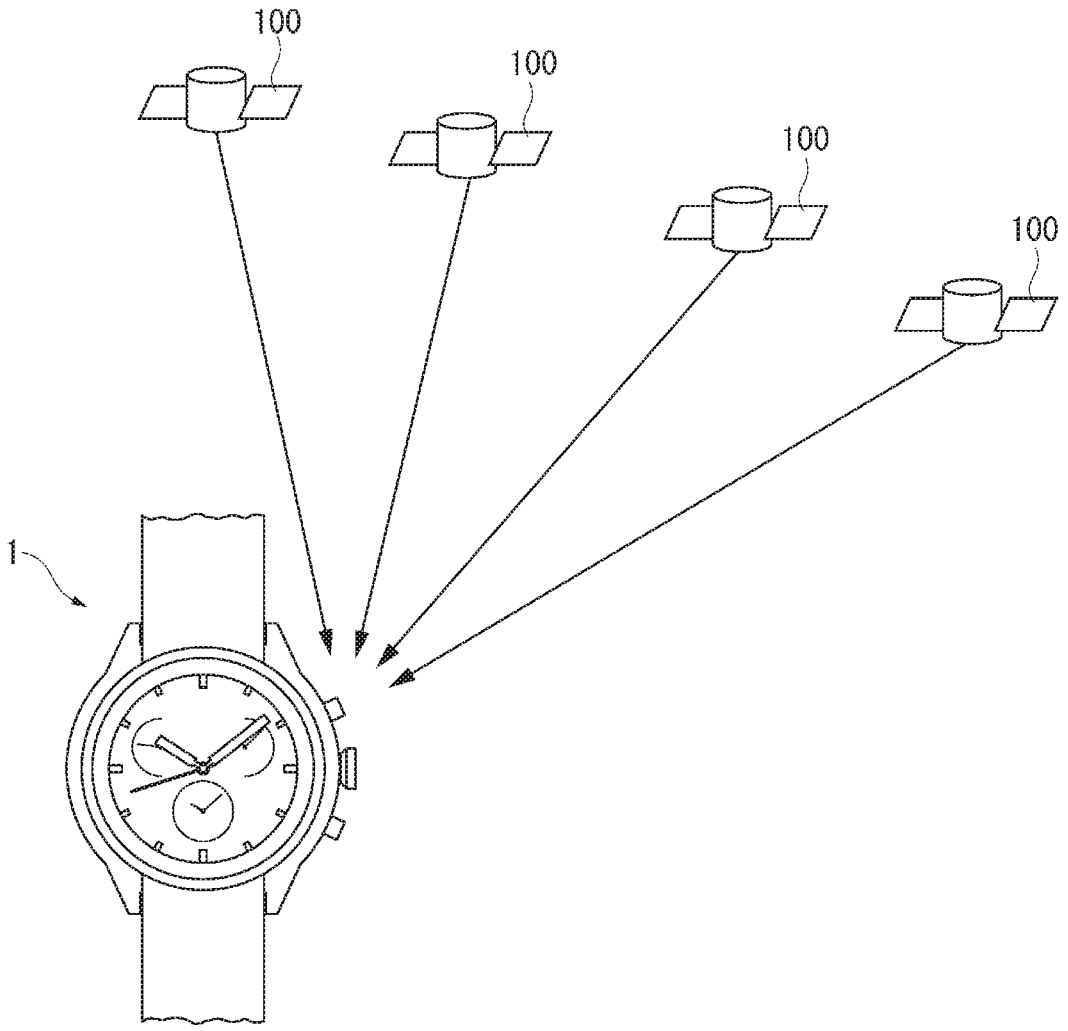
FIG. 1 is a schematic view showing an electronic timepiece in a first embodiment according to the invention.

FIG. 1 is a schematic view showing an electronic timepiece 1 according to the present embodiment.

The electronic timepiece 1 is configured to receive a satellite signal from at least one of a plurality of GPS (global positioning system) satellites 100, which go along a predetermined orbit around the earth up in the sky to acquire time information and receive satellites signals from at least three of the GPS satellites 100 to calculate and acquire position information. The GPS satellites 100 are each an example of a position information satellite, and a plurality of GPS satellites 100 are present around the earth up in the sky. About 30 GPS satellites 100 go around the earth at present.

Schematic Configuration of Electronic Timepiece

Figure 2:
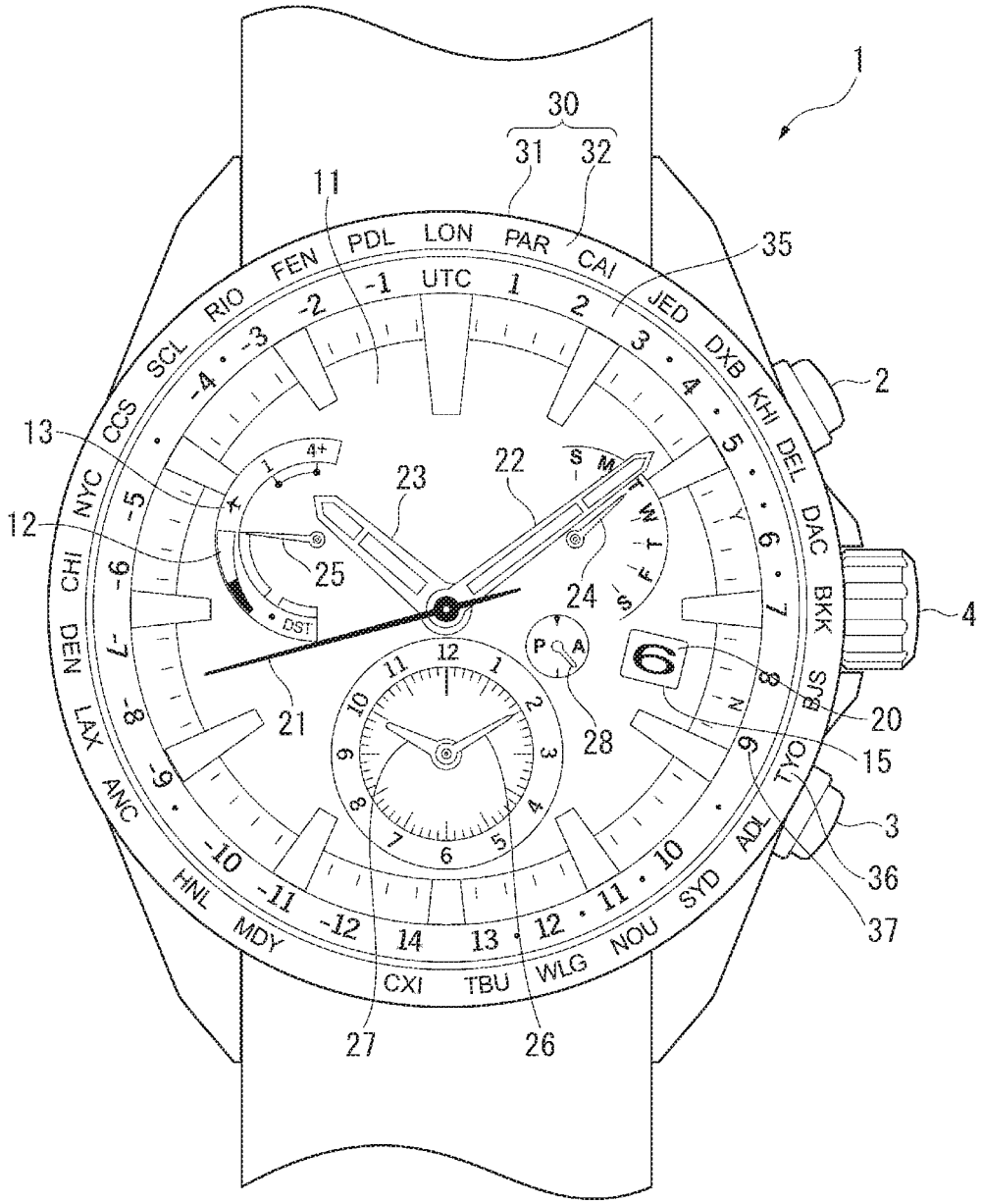
FIG. 2 is a front view of the electronic timepiece in the first embodiment.
Figure 3:
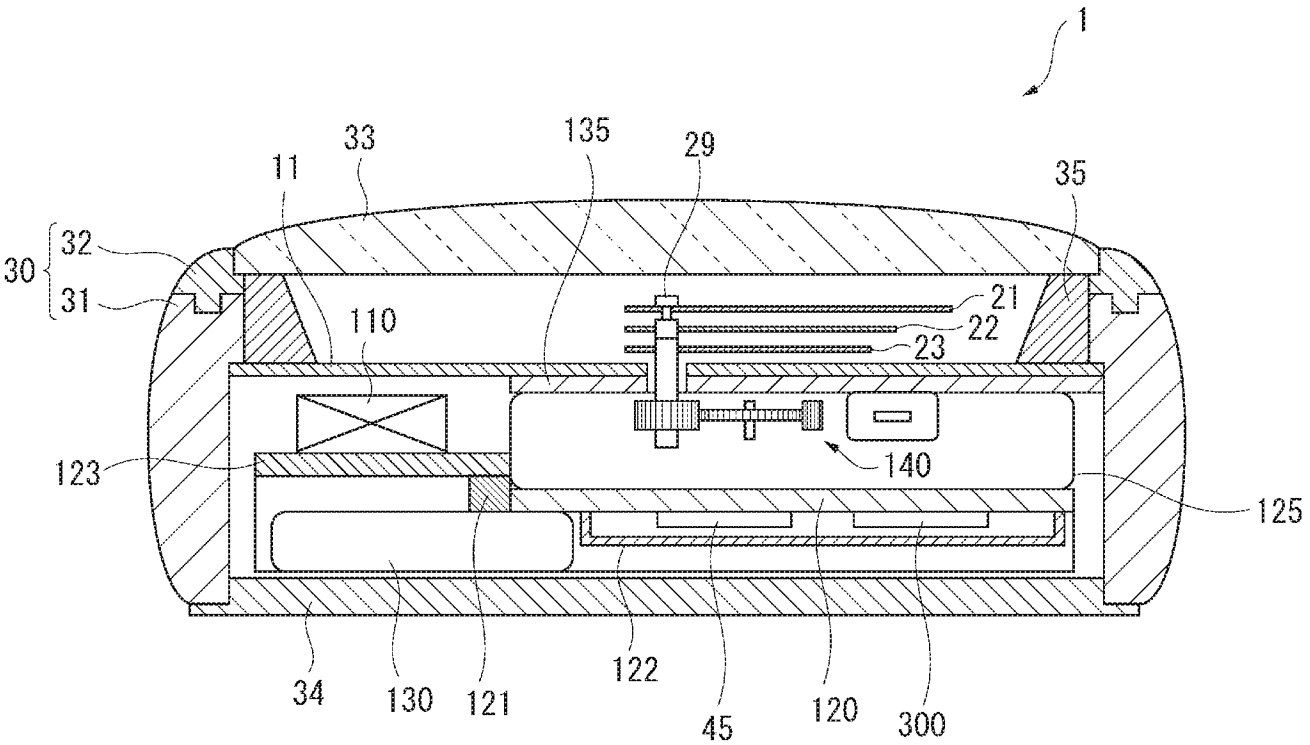
FIG. 3 is a cross-sectional view of the electronic timepiece in the first embodiment.

FIG. 2 is a front view of the electronic timepiece 1, and FIG. 3 is a cross-sectional view schematically showing the electronic timepiece 1.

The electronic timepiece 1 includes an exterior case 30, a cover glass plate 33, and a case back 34, as shown in FIGS. 2 and 3.

The exterior case 30 is so configured that a bezel 32 made of a ceramic material is fit onto the front surface of a cylindrical case 31 made of a metal. The exterior case 30 has two openings; the front-side opening is closed with the cover glass plate 33, and the rear-side opening is closed with the case back 34 made of a metal, as shown in FIG. 3.

An A button 2, a B button 3, and a crown 4 are provided on the side surface of the exterior case 30.

In the exterior case 30 are provided a dial ring 35, a dial 11, indicating hands 21, 22, 23, 24, 26, 27, and 28, which are time displaying indicating hands, an indicating hand 25, which is a mode hand, a calendar wheel 20, a movement 125, which drives the indicating hands and the calendar wheel 20, and other components.

The dial ring 35 has a ring shape and is made of a plastic material.

The dial 11 is made of a light transmissive material, such as a plastic material. The dial 11 is a circular plate member that displays time inside the exterior case 30, provided with the indicating hands 21 to 28 between the dial 11 and the cover glass plate 33, and disposed inside the dial ring 35.

In the dial 11 are formed a hole through which an indicating hand shaft 29 for the indicating hands 21, 22, and passes, holes which are not shown but through which indicating hand shafts for the indicating hands 24, 25, 26, 27, and 28 pass, and an opening that forms a calendar small window 15.

A solar panel 135 is provided between the dial 11 and the movement 125.

The solar panel 135 is a photoelectric power generation device that performs photoelectric power generation in which optical energy is converted into electrical energy. The solar panel 135 can receive light having passed through the cover glass plate 33 and the dial 11 to perform the photoelectric power generation.

The case back side of the movement 125 is covered with a circuit substrate 120. A drive mechanism 140, with which the movement 125 is provided, includes a stepper motor and a wheel train formed, for example, of gears, and the stepper motor rotates the indicating hand shafts via the wheel train to drive the indicating hands 21 to 28 and the calendar wheel 20.

The drive mechanism 140 specifically includes first to sixth drive mechanism. The first drive mechanism drives the indicating hands 22 and 23. The second drive mechanism drives the indicating hand 21. The third drive mechanism drives the indicating hand 24. The fourth drive mechanism drives the indicating hand 25. The fifth drive mechanism drives the indicating hands 26, 27, and 28. The sixth drive mechanism drives the calendar wheel 20.

A GPS antenna 110 is an antenna that receives microwaves that belong to a 1.5-GHz band, is disposed on the rear side of the dial 11, and is mounted on a case-back-side antenna substrate 123. A portion that forms the dial 11 and overlaps with the GPS antenna 110 in the direction perpendicular to the dial 11 is made of a material through which microwaves in the 1.5-GHz band readily pass (non-metal material having low conductivity and permeability). Further, the solar panel 135 including electrodes is not present between the GPS antenna 110 and the dial 11. The GPS antenna 110 can therefore receive satellite signals having passed through the cover glass plate 33 and the dial 11.

The GPS antenna 110 can, for example, be a patch antenna (microstrip antenna), a helical antenna, a chip antenna, or an inverted F antenna.

A secondary battery 130 is provided on the case back side of the antenna substrate 123. The secondary battery 130 is a power source of the electronic timepiece 1 and accumulates the electric power generated by the solar panel 135. The secondary battery 130 can, for example, be a lithium ion battery.

The circuit substrate 120 is connected to the antenna substrate 123 and the secondary battery 130 via a connector 121. The circuit substrate 120 is provided, for example, with a control device 300 and a reception device 45 on the case-back-side of the circuit substrate 120. A circuit retainer for covering the control device 300, the reception device 45, and other components is provided on the case-back-side of the circuit substrate 120.

Display Mechanism of Electronic Timepiece

The indicating hands 21, 22, and 23 are attached to the indicating hand shaft 29, which is provided at the center of the dial 11 in the plan view and along the frontward/rearward direction of the dial 11. The indicating hand shaft 29 is formed of three indicating hand shafts to which the indicating hands 21, 22, and 23 are attached.

Markings are written on an inner circumferential portion of the dial ring 35, which surrounds the outer circumference of the dial 11, and divide the inner circumference of the dial ring 35 into 60 segments, as shown in FIG. 2. The indicating hand 21 uses the markings to display the "second" of first time (local time: local time in a case where a user is present abroad, for example), the indicating hand 22 uses the markings to display the "minute" of the first time, and the indicating hand 23 uses the markings to display the "hour" of the first time. The "second" of the first time is the same as the "second" of second time, which will be described later, and the user can therefore grasp the "second" of the second time by looking at the indicating hand 21. The indicating hand 21 is the longest of the indicating hands provided in the electronic timepiece 1.

On the dial ring 35 are further written English letters, an alphabetical letter "Y" at the 12-minute position and an alphabetical letter "N" at the 18-minute position. The indicating hand 21 points one of "Y" and "N" to display a result of reception of satellite signals.

The indicating hand 24 is attached to an indicating hand shaft provided in a position shifted from the center of the dial 11 in the plan view toward the 2-hour direction and displays the day of a week.

The indicating hand 25 is attached to an indicating hand shaft provided in a position shifted from the center of the dial 11 in the plan view toward the 10-hour direction.

"DST" and a black dot are written on an outer circumferential portion of an area along which the indicating hand 25 rotates. DST denotes daylight saving time. The hand 25 points to either DST or the dot depending on whether or not the electronic timepiece 1 is set to the DST mode (DST meaning the daylight saving time mode is on, and the black dot meaning the DST mode is off).

A crescent/sickle-shaped symbol 12 is further written on the outer circumferential portion of the area along which the indicating hand 25 rotates. The symbol 12 is an indicator that indicates the remaining power of the secondary battery 130, and the indicating hand 25 points a position according to the remaining battery capacity to display the remaining battery capacity.

An airplane-shaped symbol 13 is further written on the outer circumferential portion of the area along which the indicating hand 25 rotates. The symbol represents a flight mode. The indicating hand 25 points the symbol 13 to indicate that the flight mode has been set and no reception is performed.

A numeral "1" and a symbol "4+" are further written on the outer circumferential portion of the area along which the indicating hand 25 rotates. The numeral and the symbol represent satellite signal reception modes. "1" means that GPS time information is received and the internal time is corrected (time measurement mode), and "4+" means that GPS time information and orbit information are received, position information representing the current position is calculated, and the internal time and the time difference are corrected (position measurement mode).

The indicating hands 26 and 27 are attached to indicating hand shafts provided in the same position shifted from the center of the dial 11 in the plan view toward the 6-hour direction. The indicating hand 26 displays the "minute" of the second time (home time: time in Japan in a case where the user is present abroad, for example), and the indicating hand 27 displays the "hour" of the second time. The indicating hand 28 is attached to an indicating hand shaft provided in a position shifted from the center of the dial 11 in the plan view toward the 4-hour direction. The indicating hand 28 displays a.m. and p.m. of the second time.

The calendar small window 15 is provided in the form of an opening that opens through the dial 11 and has a rectangular shape, and the calendar small window 15 allows visual recognition of a numeral printed on the calendar wheel 20. The calendar wheel 20, numerals on which are visually recognized through the opening, displays the "day" of the year, month, and day corresponding to the first time.

Time difference information 37, which represents the time difference from the universal coordinated time (UTC), numerals, is written in the form of numerals and symbols other than numerals on the dial ring 35 along the markings on the inner circumferential side.

City information 36, which represents the names of representative cities where standard time corresponding to the time difference information 37 written on the dial ring 35 is used, is written, along with the time difference information 37, on the bezel 32, which is provided around the dial ring 35.

The indicating hand 21 points the time difference information 37 and the city information 36 to display time difference information.

Internal Configuration of Electronic Timepiece

Figure 4:
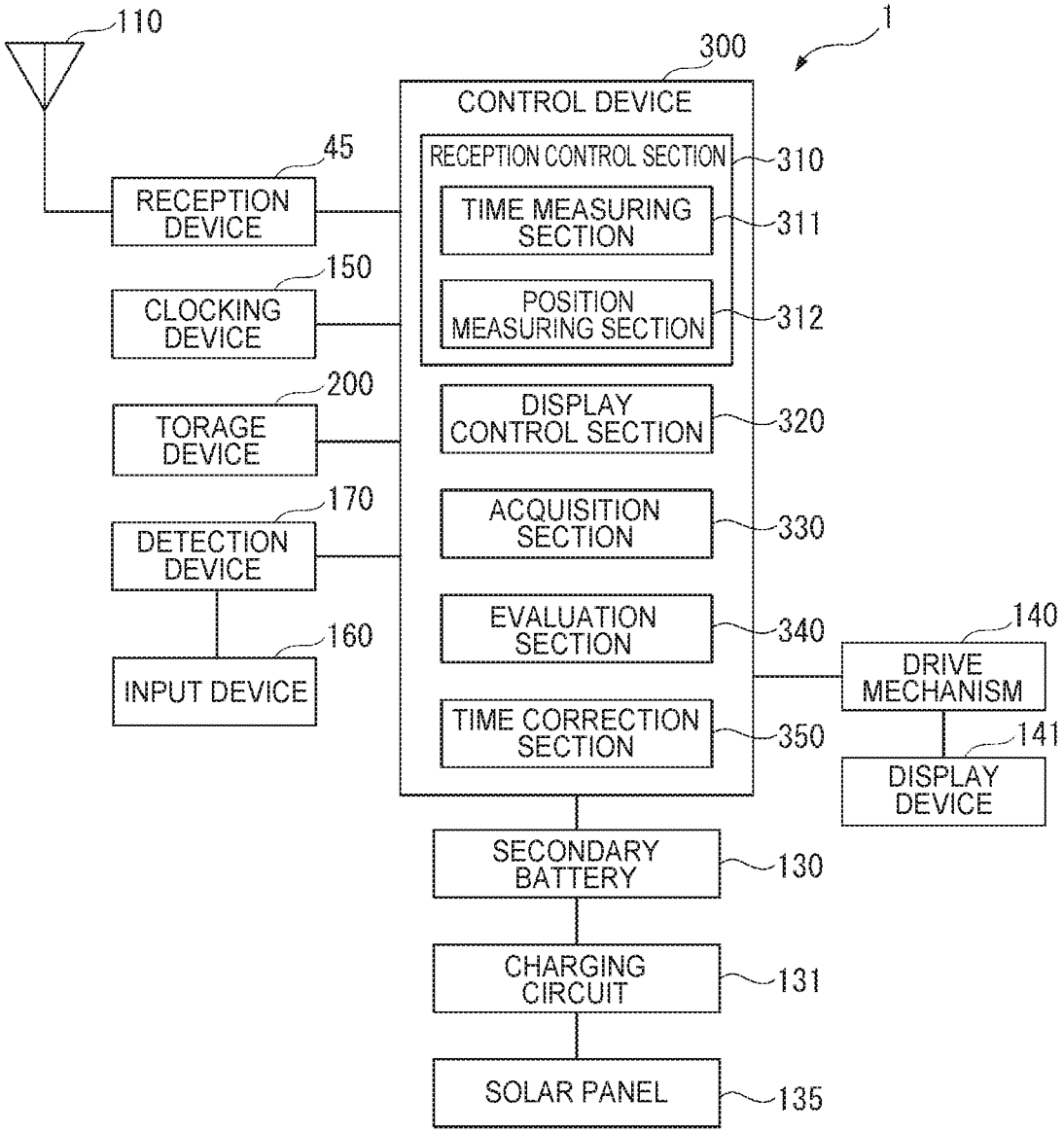
FIG. 4 is a control block diagram of the electronic timepiece in the first embodiment.

FIG. 4 is a control block diagram of the electronic timepiece 1.

The electronic timepiece 1 includes the control device 300, which is formed of a CPU (central processing unit), a storage device 200, which is formed, for example, of a RAM (random access memory) and an EEPROM (electrically erasable and programmable read only memory), the reception device (GPS module) 45, a clocking device 150, an input device 160, a detection device 170, the drive mechanism 140, and a display device 141, as shown in FIG. 4. The devices described above transmit and receive data via a data bus.

The electronic timepiece 1 further includes the built-in, rechargeable secondary battery 130, which serves as a power source. The secondary battery 130 is charged with the electric power supplied from the solar panel 135 via a charging circuit 131.

Input Device

The input device 160 is formed of the crown 4, the A button 2, and the B button 3 shown in FIG. 2. The input device 160 is an example of an operation section.

Detection Device

The detection device 170 detects operation that instructs execution of a variety of processes on the basis of operation of pressing and releasing the buttons 2 and 3 and operation of pulling, pushing, and rotating the crown 4 and outputs an operation signal according to the detected operation to the control device 300.

Display Device

The display device 141 is formed, for example, of the dial 11, the dial ring 35, the bezel 32, the indicating hands 21 to 28, and the calendar wheel 20 shown in FIG. 2.

Reception Device

The reception device 45 is connected to the GPS antenna 110 and processes satellite signals received via the GPS antenna 110 to acquire the time information and the position information. The GPS antenna 110 receives an electric wave transmitted from each of the GPS satellites 100 and passes through the cover glass plate 33 and the dial ring 35 shown in FIG. 3.

The reception device 45 includes, although not shown, an RF (radio frequency) section that receives a satellite signal transmitted from any of the GPS satellites 100 and converts the satellite signal into a digital signal, a BB section (baseband section) that performs correlation evaluation of the received signal to demodulate a navigation message, and an information acquisition section that acquires the time information and the position information from the demodulated navigation message (satellite signal) from the BB section and outputs the time information and the position information.

The BB section produces C/A code patterns relating to the GPS satellites 100, determines values representing the correlation between each of the C/A codes and the received satellite signal, and searches for and captures a GPS satellite 100 with which any of the C/A codes can synchronize.

In the search for the GPS satellite 100, a threshold of the received signal level is first set to a first, highest threshold. The threshold of the received signal level is a threshold for evaluating a GPS satellite 100 being captured. That is, a GPS satellite 100 that provides a reception signal level higher than the threshold is determined as a captured satellite. After all the GPS satellites 100 are searched for by using the first threshold, the first threshold is switched to a second threshold smaller than the first threshold, and all the GPS satellites 100 are searched for in the same manner. All the GPS satellites 100 are searched for sequentially by using a plurality of settable received signal levels.

The reception device 45 notifies, for example, every one second the control device 300 of the number of captured GPS satellites 100.

The search using each of the thresholds takes at least one second, and the smaller the threshold of the received signal level, the longer the search period. The number of captured satellites notified by the reception device 45 immediately after the start of reception is outputted, for example, at a timing when all the GPS satellites 100 have not been searched for by using the first threshold. The number of captured satellites notified two to three seconds after the start of reception is also likely to be notified in the middle of the search using the first or second threshold. That is, there is a case where the notified number of captured satellites is fewer than the number of satellites that can be actually captured throughout the search. Several seconds after the start of reception, the search for a GPS satellite 100 of high reception signal level has been completed, whereby it can be decided that the number of satellites that can be captured is roughly fixed.

The number of thresholds of the received signal level in the search, the period required for the search using each of the thresholds, and the interval at which the number of captured satellites is notified can be set as appropriate.

Navigation Message

The navigation message, which is a satellite signal transmitted from a GPS satellite 100 and contains the acquired information described above, will now be described. It is noted that the navigation message is modulated in the form of 50-bps data into a satellite electric wave.

Figure 5:
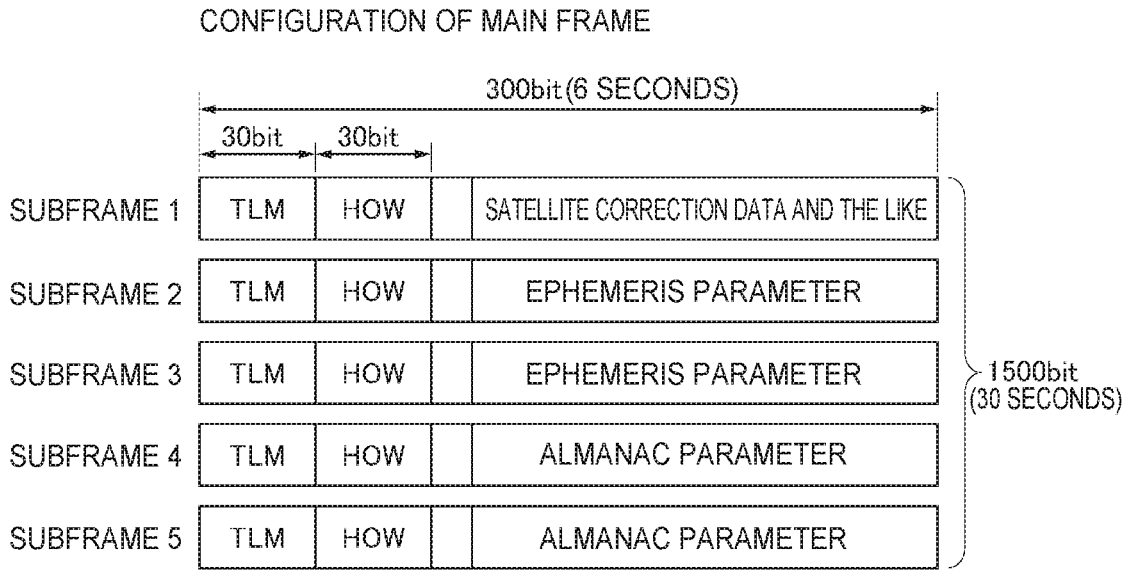
FIG. 5 shows the configuration of a main frame of a navigation message.
Figure 6:
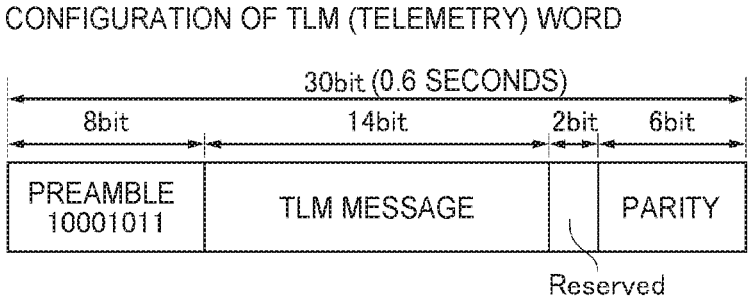
FIG. 6 shows the configuration of a TLM word in the navigation message.
Figure 7:
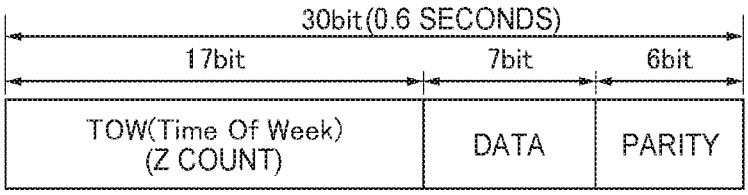
FIG. 7 shows the configuration of a HOW word in the navigation message.

FIGS. 5 to 7 describe the configuration of the navigation message.

The navigation message is configured as data formed of a main frame as a unit including 1500 bits in total, as shown in FIG. 5. The main frame is divided into five subframes 1 to 5, each of which includes 300 bits. The data in one subframe is transmitted in 6 seconds from each of the GPS satellites 100. The data in one main frame is therefore transmitted in 30 seconds from each of the GPS satellites 100.

The subframe 1 contains week number (WN) data and satellite correction data.

The week number data is information representing a week that contains information on the current GPS time and is updated on a one-week basis.

The subframes 2 and 3 each contain an ephemeris parameter (information on detailed orbit of each GPS satellite 100). The subframes 4 and 5 each contain an almanac parameter (information on schematic orbit of all GPS satellites 100).

Further, the subframes 1 to 5 each contain a TLM (telemetry) word that stores 30-bit TLM (telemetry word) data and a HOW word (hand over word) that stores 30-bit HOW data with the TLM word and the HOW word sequentially stored at start segments of the subframe.

Therefore, the TLM word and the HOW word are transmitted from a GPS satellite 100 at 6-second intervals, whereas the week number data, the satellite correction data, the ephemeris parameters, and the almanac parameters are transmitted at 30-second intervals.

The TLM word contains preamble data, a TLM message, a reserved bit, and parity data, as shown in FIG. 6.

The HOW word contains GPS time information called TOW (time of week, also called "Z count"), as shown in FIG. 7. The Z count is data in which the period having elapsed since 12 o'clock midnight on every Sunday is expressed in seconds and returns to 0 at 12 o'clock midnight on the following Sunday. That is, the Z count data is information on a second basis presented every week at the start of the week. The Z count data represents information on GPS time when the first bit in the following subframe data is transmitted.

The electronic timepiece 1 can therefore acquire date information and time information by acquiring the week number data contained in the subframe 1 and the HOW word (Z count data) contained in each of the subframes 1 to 5. It is, however, noted that in a case where the electronic timepiece 1 acquired the week number data in the past and internally counts the period having elapsed since the point of time when the week number data was acquired, the electronic timepiece 1 can obtain the current week number data relating to the GPS satellite 100 without acquisition of the week number data.

The electronic timepiece 1 therefore only needs to acquire the week number data in the subframe 1 only in a case where no week number data (date information) is internally stored. In the case where the week number data is stored, the electronic timepiece 1 knows the current time only by acquiring TOW transmitted every 6 seconds. The electronic timepiece 1 therefore typically acquires only TOW as the time information.

Clocking Device

The clocking device 150 includes a quartz oscillator or any other component driven with the electric power accumulated in the secondary battery 130 and updates time data by using a reference signal based on an oscillation signal from the quartz oscillator.

Storage Device

Figure 8:
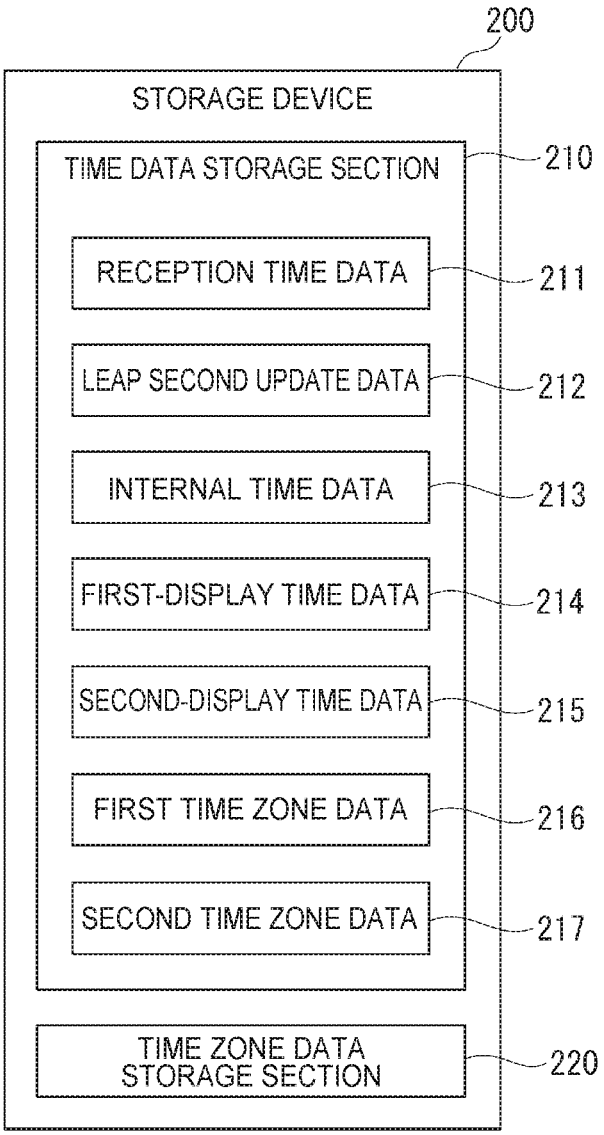
FIG. 8 is a data structure diagram of a storage device in the first embodiment.

The storage device 200 includes a time data storage section 210 and a time zone data storage section 220, as shown in FIG. 8.

The time data storage section 210 stores reception time data 211, leap second update data 212, internal time data 213, first-display time data 214, second-display time data 215, first time zone data 216, and second time zone data 217.

The reception time data 211 stores the time information (GPS time) acquired from a satellite signal. The reception time data 211 is typically updated every one second by the clocking device 150, and when a satellite signal is received, the acquired time information is stored in the reception time data 211.

The leap second update data 212 stores at least current leap second data. That is, the page 18 in the subframe 4 of a satellite signal contains the following data as data on the leap second: "current leap second;" "week in which leap second is updated;" "day on which leap second is updated;" and "updated leap second". Among them, at least the data on the "current leap second" is stored in the leap second update data 212 in the present embodiment.

The internal time data 213 stores internal time information. The internal time information is updated by the GPS time stored in the reception time data 211 and the "current leap second" stored in the leap second update data 212. That is, the internal time data 213 stores UTC (universal coordinated time). When the reception time data 211 is updated by the clocking device 150, the internal time information is also updated.

The first-display time data 214 stores time information obtained by modifying the internal time information in the internal time data 213 in consideration of time zone data (time difference information) in the first time zone data 216. The first time zone data 216 is set by using time zone data obtained when the user manually selects the time zone or when the time zone is received in the position measurement mode. The time information in the first-display time data 214 corresponds to the first time displayed by the indicating hands 21, 22, and 23 and the calendar wheel 20.

The second-display time data 215 stores time information obtained by modifying the internal time information in the internal time data 213 in consideration of time zone data in the second time zone data 217. The second time zone data 217 is set by using time zone data obtained when the user manually selects the time zone. The time information in the second-display time data 215 corresponds to the second time displayed by the indicating hands 26, 27, and 28.

The time zone data storage section 220 stores the position information (latitude, longitude) and the time zone data (time difference information) with them related to each other. Therefore, in a case where position information is acquired in the position measurement mode, the control device 300 can acquire time zone data on the basis of the position information (latitude, longitude). The control device 300 can also acquire time zone data from the time zone data storage section 220 through operation of the crown 4.

Control Device 300

The control device 300 is formed of a CPU that controls the electronic timepiece 1. The control device 300 executes a reception control program stored in the storage device 200 to function as a reception control section 310, a display control section 320, an acquisition section 330, an evaluation section 340, and a time correction section 350.

The reception control section 310 includes a time measuring section 311 and a position measuring section 312. The time measuring section 311 activates the reception device 45 to execute a reception process in the time measurement mode. The position measuring section 312 activates the reception device 45 to execute a reception process in the position measurement mode.

The display control section 320 controls the indicating hands 21 to 28 and the calendar wheel 20 to cause them to display each piece of information.

The acquisition section 330 calculates and acquires the number of captured satellites as information on the reception state (reception state information).

The evaluation section 340 evaluates whether or not the state of the reception process satisfies a condition under which a preset number of captured satellites (reception state information) is displayed.

The time correction section 350 corrects the first time and the second time.

The functions of each of the sections will be described in detail in the following description of a time measurement/reception control process.

Time Measurement/Reception Control Process

Figure 9:
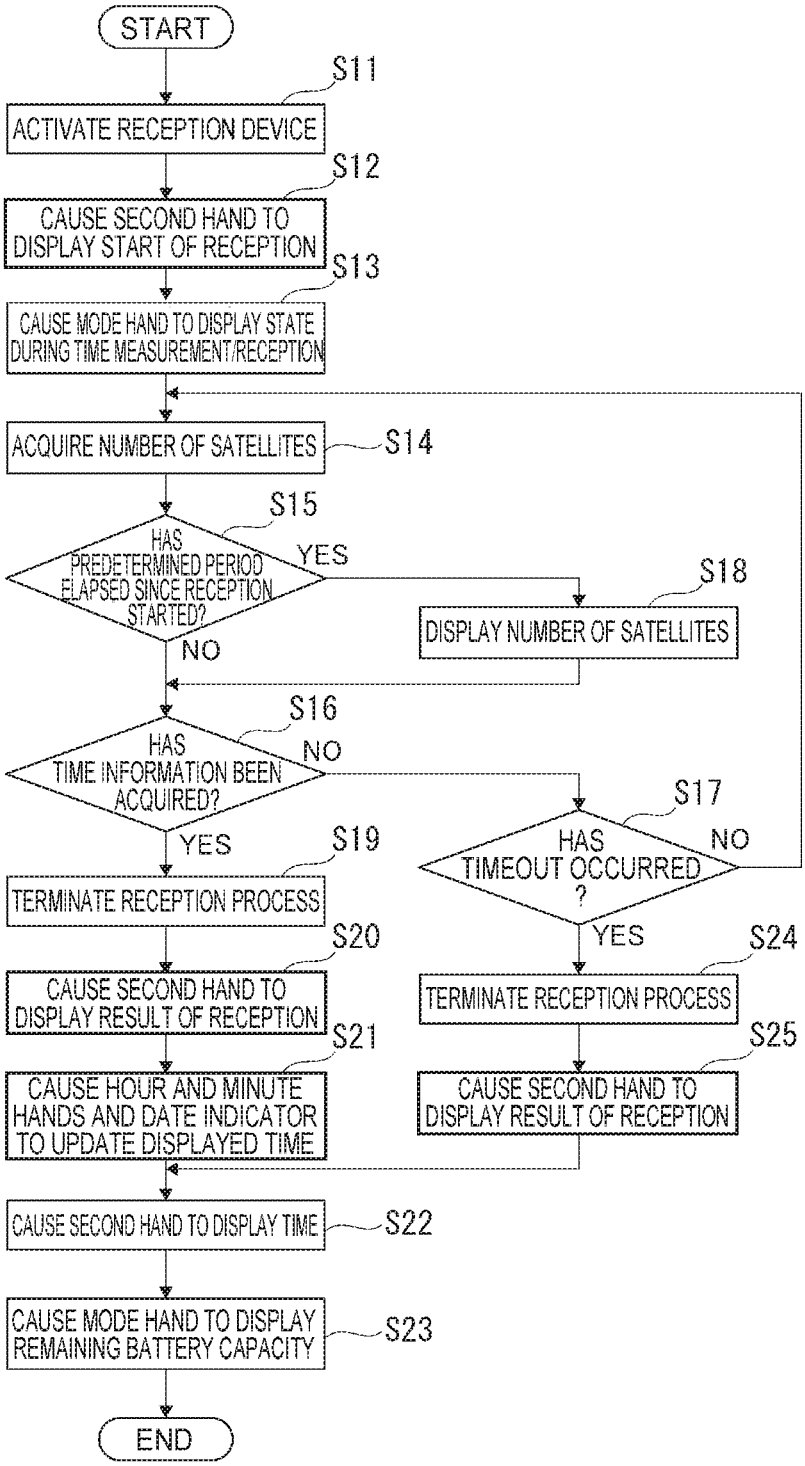
FIG. 9 is a flowchart showing a time measurement/reception process in the first embodiment.

A time measurement/reception control process executed by the electronic timepiece 1 will next be described. FIG. 9 is a flowchart showing the time measurement/reception control process.

When the A button 2 is pressed for a period longer than or equal to 3 seconds but shorter than 6 seconds to perform reception start operation that starts the reception process in the time measurement mode (time measurement/reception process), the reception control section 310 detects the operation on the basis of an operation signal outputted from the detection device 170 and activates the time measuring section 311. The time measuring section 311 activates the reception device 45 to start the time measurement/reception process (S11). When the time measurement/reception process is executed, the reception device 45 executes the process of capturing the GPS satellites 100. The reception device 45 captures at least one GPS satellite 100 and receives the satellite signal transmitted from the GPS satellite 100 to acquire the time information.

The display control section 320 then causes the indicating hand 21 (second hand) to point the 0-second position, so that start information representing that the reception process has started is displayed (S12). That is, the indicating hand 21 also serves as a start information displaying indicating hand that displays the start information.

The display control section 320 then causes the indicating hand 25 (mode hand) to point the numeral "1", which indicates that the time measurement/reception process is being executed (S13).

The acquisition section 330 then acquires the number of captured GPS satellites 100 (number of captured satellites)

as the reception state information on the reception state from the reception device 45 (S14).

The evaluation section 340 then evaluates whether or not a predetermined period has elapsed since the reception process started (S15). The predetermined period can be set in accordance with the number of thresholds of the reception signal level in the search, the period required for the search using each of the thresholds, the intervals at which the number of captured satellites is notified, and other factors and is set, for example, at 5 or 6 seconds.

First, a result of the evaluation in S15 shows NO, and the evaluation section 340 evaluates in S16 whether or not the time information has been successfully acquired.

In a case where a result of the evaluation in S16 shows NO, the evaluation section 340 evaluates whether or not timeout has occurred (S17). In a case where a result of the evaluation in S17 shows NO, the evaluation section 340 returns the process to S14. The processes in S14, S15, S16, and S17 are therefore repeatedly executed until the predetermined period elapses after the start of the reception process except the case where the time information has been successfully acquired. During the period described above, the number of captured satellites is not displayed.

When the predetermined period has elapsed with acquisition of no time information since the reception process started, the evaluation section 340 determines a result of the evaluation in S15 is YES and determines that the condition under which the number of captured satellites is displayed is satisfied. The display control section 320 then causes the indicating hand 21 to display the number of captured satellites acquired in S14 (S18). Specifically, the display control section 320 causes the indicating hand 21 to point the position representing the hour value corresponding to the number of captured satellites among the positions representing the hour values from 0 to 11, whereby the number of captured satellites is displayed. For example, in a case where the number of captured satellites is 5, the display control section 320 causes the indicating hand 21 to point the 5-hour position (25-second position). In this process, the display control section 320 causes the indicating hand 21 pointing the 0-second position to make one turn and then display the number of captured satellites. Therefore, even in a case where the number of captured satellites is "0", the indicating hand 21 makes one turn and then points the 0-hour position, whereby the user can understand that the indicating hand 21 displays the number of captured satellites. That is, the indicating hand 21 also serves as an indicating hand or a display section that displays the reception state information.

After the number of captured satellites is displayed, the evaluation section 340 evaluates in S16 whether or not the time information has been successfully acquired, and in a case where a result of the evaluation in S16 shows NO, the evaluation section 340 advances the process to S17. The processes in S14, S15, S18, S16, and S17 are therefore repeatedly executed after the predetermined period elapsed but no time information was acquired except the case where the time information has been successfully acquired.

In a case where the time information has been acquired and a result of the evaluation in S16 shows YES, the time measuring section 311 deactivates the reception device 45 and terminates the reception process (S19).

The display control section 320 then causes the indicating hand 21 to display a result of the reception as one kind of predetermined information (S20). In the embodiment, the display control section 320 causes the indicating hand 21 to point "Y", which indicates successful reception. That is, the indicating hand 21 also serves as an indicating hand that displays predetermined information or a reception result displaying indicating hand.

In the process of causing the indicating hand 21 to display a result of the reception, in the middle of the movement of the indicating hand 21 for displaying the number of captured satellites, stopping and causing the moving indicating hand 21 to display a result of the reception results in unnatural display. The display control section 320 therefore causes the indicating hand 21 to display the number of captured satellites (allows indicating hand 21 to complete movement) and then the causes the indicating hand 21 to display a result of the reception.

The time correction section 350 then causes the reception time data 211 to store the acquired time information. The internal time data 213, the first-display time data 214, and the second-display time data 215 are thus corrected. The display control section 320 then causes the indicating hand 22 (minute hand), the indicating hand 23 (hour hand), and the calendar wheel 20 (date indicator) to display the minute, hour, and date of the corrected first time and causes the indicating hands 26, 27, and 28 to display the minute, hour, and a.m./p.m. of the corrected second time (S21).

After the process in S21, the display control section 320 causes the indicating hand 21 having displayed a result of the reception to display the second of the first time as one kind of predetermined information (S22).

The display control section 320 then causes the indicating hand 25 to point the symbol 12, which indicates the remaining battery capacity (S23). The control device 300 then terminates the time measurement/reception control process.

On the other hand, in a case where no time information was acquired but timeout occurred (result of the evaluation in S17 shows YES), the time measuring section 311 deactivates the reception device 45 and terminates the reception process (S24). The display control section 320 then causes the indicating hand 21 to point "N", which indicates unsuccessful reception (S25).

After the indicating hand 21 displays the second of the first time in S22, and the indicating hand 25 displays the remaining battery capacity in S23, the control device 300 terminates the time measurement/reception control process.

That is, according to the time measurement reception/control process, in the case where the time information has been successfully acquired since the reception process started but before the predetermined period elapses, a result of the reception and corrected time are displayed with no display of the number of captured satellites. Further, in the case where the time information has been successfully acquired since the reception process started but after the predetermined period elapsed or in the case of timeout, the number of captured satellites is displayed and a result of the reception is then displayed.

Advantageous Effects of First Embodiment

According to the electronic timepiece 1, in the case where a certain period has elapsed since the reception process started and it can be decided that the number of captured satellites is fixed, the number of captured satellites is allowed to be displayed. Further, in a case where the time information can be acquired several seconds after the reception process started, the number of captured satellites is not displayed, whereby the display of a result of the reception or the display of corrected time is not delayed due to the display of the number of captured satellites, and the result of the reception and the corrected time can therefore be quickly displayed. The convenience provided by the electronic timepiece 1 can thus be improved.

Since the indicating hand 21 (second hand), which is the longest indicating hand, displays the second of time, the start information, the number of captured satellites, and a result of the reception, these pieces of information can be displayed in an easy-to-understand manner.

Second Embodiment

In the first embodiment, the evaluation section 340 determines that the condition under which the number of captured satellites is displayed is satisfied only when the predetermined period has elapsed with acquisition of no time information since the reception process started. In contrast, in a second embodiment, an evaluation section 340A determines that the display condition has been satisfied also in a case where the evaluation section 340A determines that there is no chance of successful reception.

The following description will be primarily made of components different from those in the first embodiment out of the components of an electronic timepiece 1A according to the second embodiment. The same components as those in the first embodiment have the same reference characters and will not be described.

Figure 10:
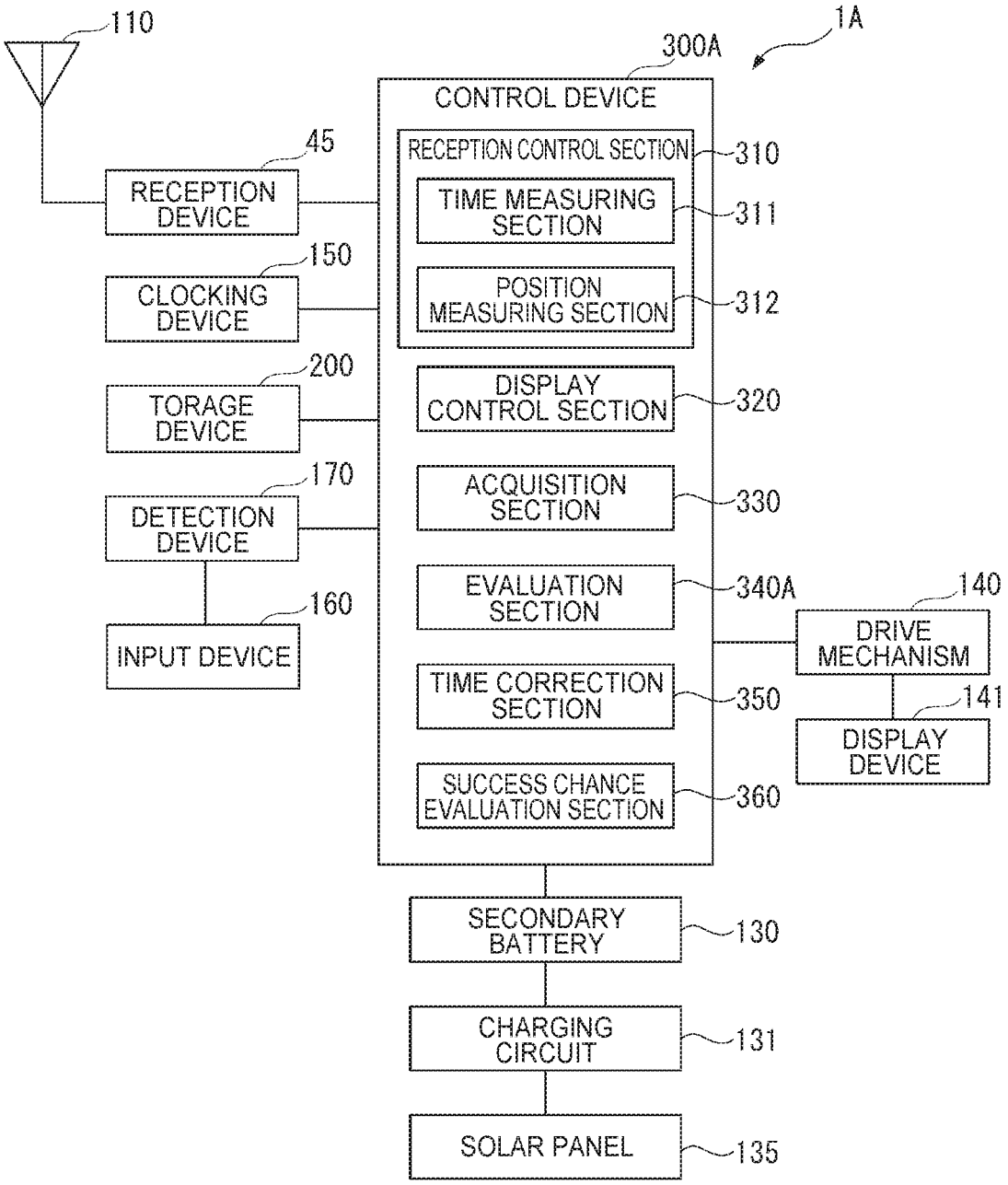
FIG. 10 is a control block diagram of an electronic timepiece in a second embodiment according to the invention.

A control device 300A in the second embodiment includes the reception control section 310, the display control section 320, the acquisition section 330, the evaluation section 340A, the time correction section 350, and a success chance evaluation section 360, as shown in FIG. 10.

The success chance evaluation section 360 evaluates whether or not there is a chance of successful reception on the basis of the state of the reception process.

Figure 11:
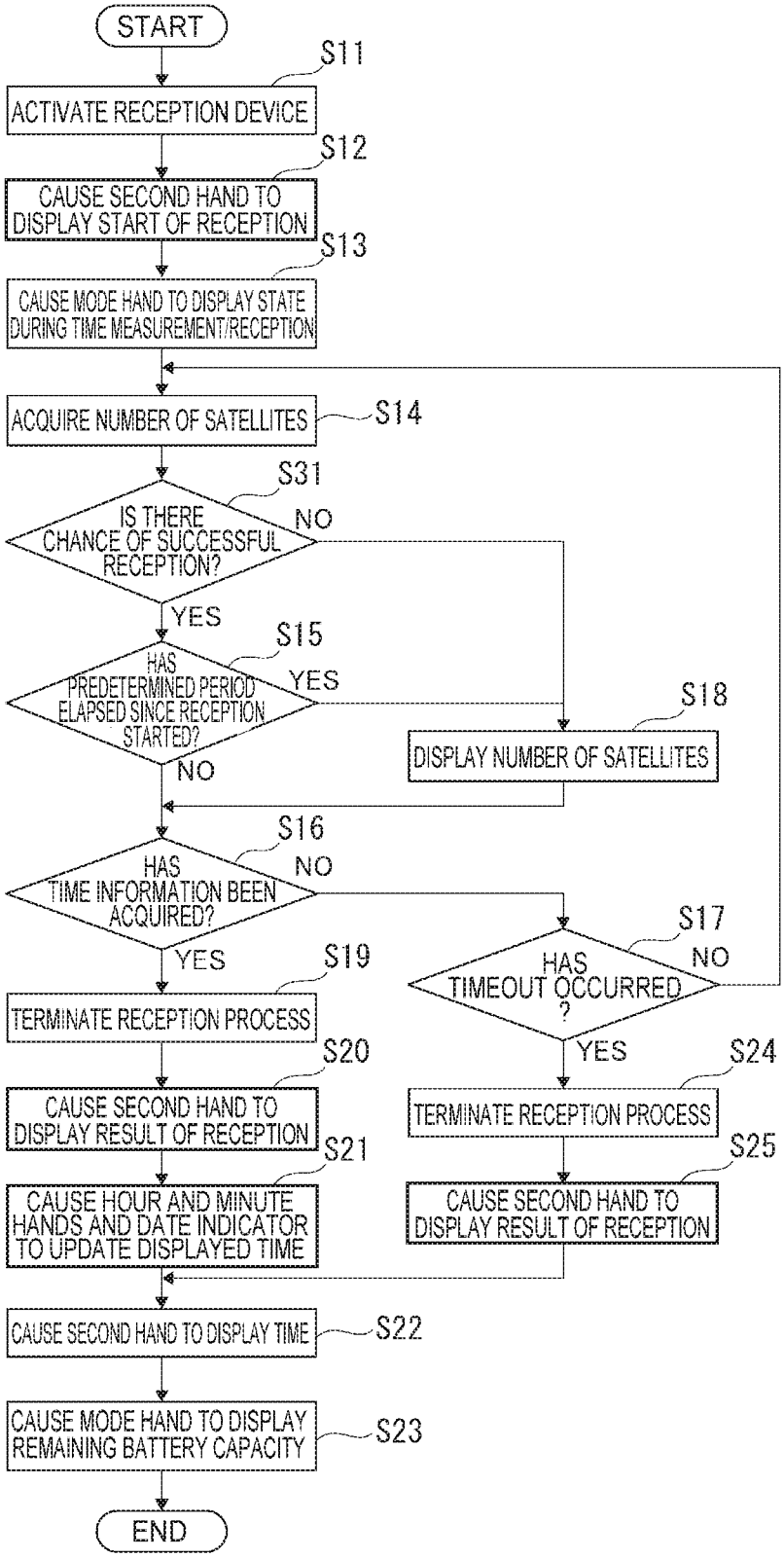
FIG. 11 is a flowchart showing a time measurement/reception process in the second embodiment.

In the time measurement/reception control process in the second embodiment, the processes in S11 to S25 and S31 are executed, as shown in FIG. 11. The processes in S11 to S25 are the same as those in the first embodiment and will not therefore be described.

After the number of captured satellites is acquired in S14, the success chance evaluation section 360 evaluates whether or not there is a chance of successful reception on the basis of the signal strength of each satellite signal being received, the state of decoding of the navigation message, and other factors (S31). In a case where the evaluation process in S31 is executed for the first time after the reception process starts, the evaluation process is executed, for example, two seconds after the reception starts.

In a case where a result of the evaluation in S31 shows NO, the evaluation section 340A determines that the condition under which the number of captured satellites is displayed is satisfied and advances the process to S18. In S18, the number of captured satellites is displayed. That is, in a case where there is no chance of successful reception, the number of captured satellites is displayed even before the predetermined period elapses after the start of the reception process. The evaluation of successful or unsuccessful reception is then performed in S16.

On the other hand, in a case where a result of the evaluation in S31 shows YES, it is evaluated in S15 whether or not the predetermined period has elapsed with no successful reception since the reception process started.

Advantageous Effects of Second Embodiment

According to the second embodiment, the same configuration as that in the first embodiment allows the same advantageous effects to be provided. The following advantageous effects can further be provided.

In the case where it is determined that there is no chance of successful reception, it can be decided that the electronic timepiece 1A is in a situation in which no GPS satellite 100 is likely to be captured, for example, a situation in which a GPS satellite 100 that provides high signal strength has not been captured. Therefore, in the case where it is determined that there is no chance of successful reception, displaying the number of captured satellites allows notification of the situation in which no GPS satellite 100 is likely to be captured.

Further, in the case where it is determined that there is no chance of successful reception, in the middle of the display of the number of captured satellites, there is a low possibility of acquisition of the time information, and there is also a low possibility of delay of the display of a result of the reception and corrected time due to the display of the number of captured satellites.

Therefore, in the case where it is determined that there is no chance of successful reception, the number of captured satellites can be displayed even before the predetermined period elapses after the start of the reception process, whereby a situation in which a successful reception environment is not achieved can be quickly displayed.

Third Embodiment

An electronic timepiece 1B according to a third embodiment displays the number of captured satellites during the execution of a position measurement/reception process.

In the time measurement/reception control process in the first embodiment, the evaluation section 340 determines that the condition under which the number of captured satellites is displayed is satisfied only when the predetermined period has elapsed with acquisition of no time information since the reception process started. In contrast, in the position measurement/reception control process in the third embodiment, an evaluation section 340B determines that the display condition described above is satisfied in a case where a predetermined period has elapsed with acquisition of no position information since the reception process started and a case where the number of captured GPS satellites 100 and the strengths of the signals therefrom satisfy a position measurable condition set in advance.

The following description will be primarily made of components different from those in the first embodiment out of the components of the electronic timepiece 1B according to the third embodiment. The same components as those in the first embodiment have the same reference characters and will not be described.

Figure 12:
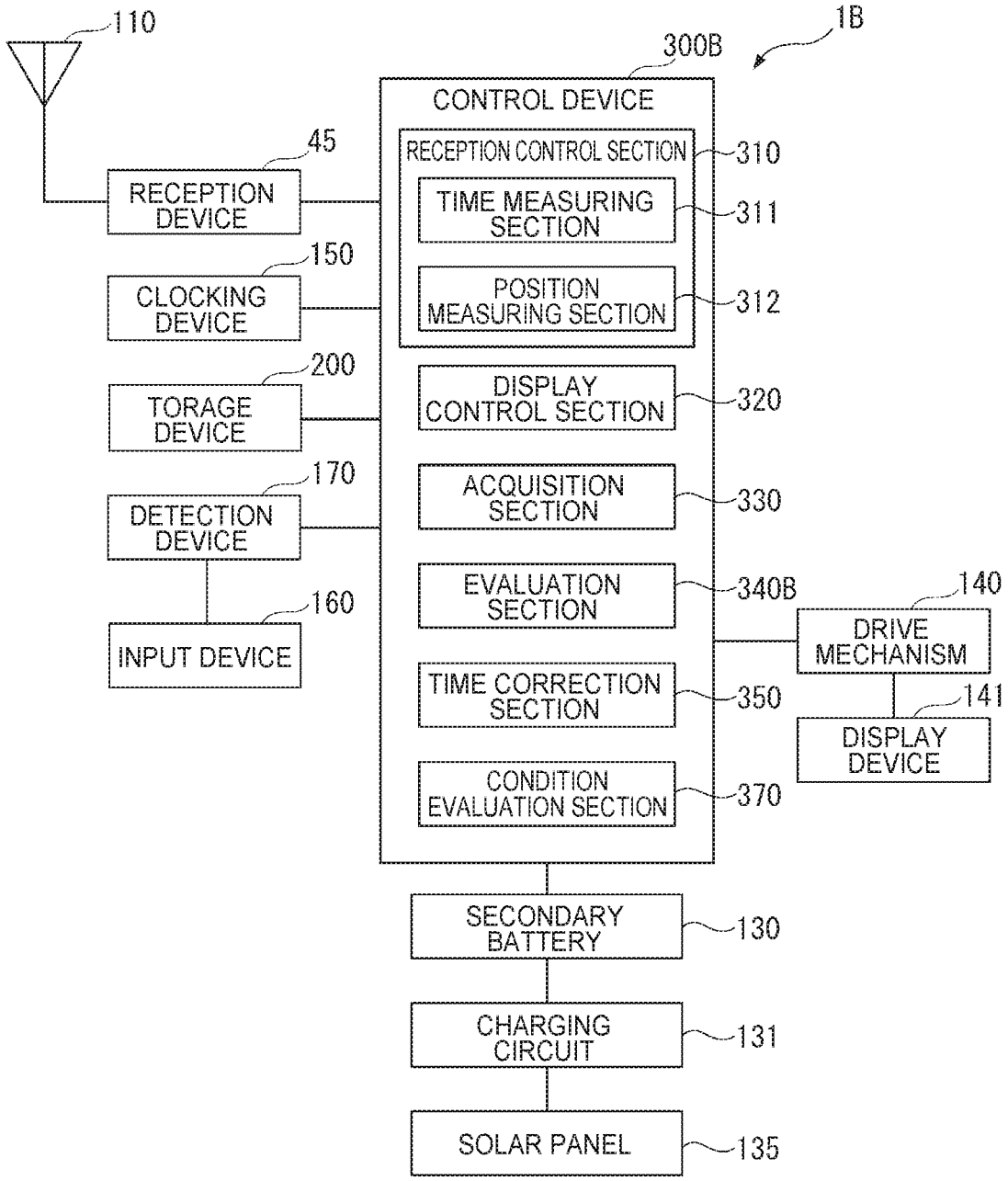
FIG. 12 is a control block diagram of an electronic timepiece in a third embodiment according to the invention.

A control device 300B in the third embodiment includes the reception control section 310, the display control section 320, the acquisition section 330, the evaluation section 340B, the time correction section 350, and a condition evaluation section 370, as shown in FIG. 12.

The condition evaluation section 370 evaluates whether or not the number of captured GPS satellites 100 and the strengths of the signals therefrom satisfy the position measurable condition set in advance.

Figure 13:
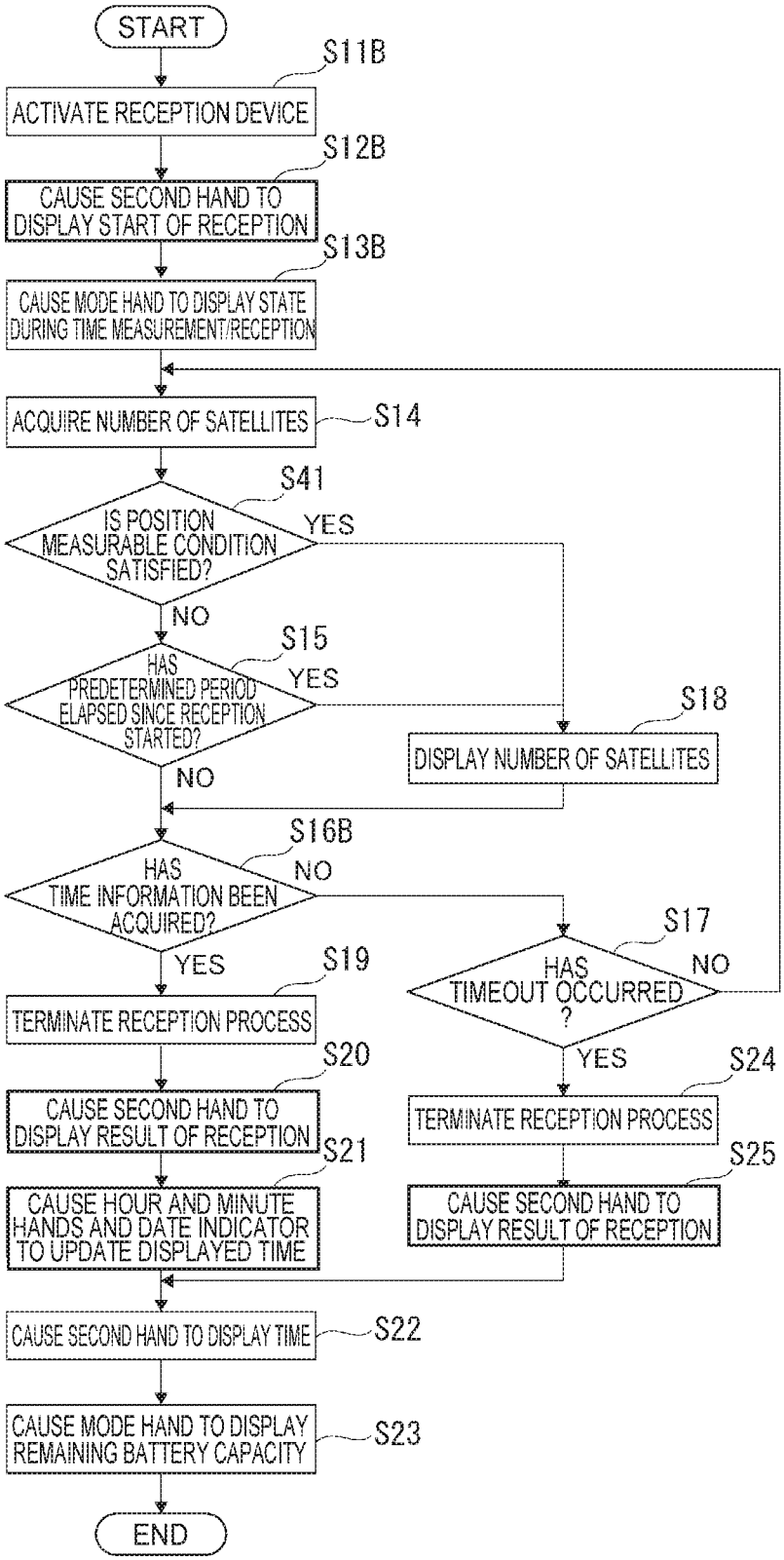
FIG. 13 is a flowchart showing a position measurement/reception process in the third embodiment.

In the position measurement/reception control process in the third embodiment, the processes in S11B, S12B, S13B, S14, S15, S16B, S17 to S25, and S41 are executed, as shown in FIG. 13. The processes in S14, S15, and S17 to S25 are the same as those in the first embodiment and will not therefore be described.

When the A button 2 is pressed at least for 6 seconds to perform reception start operation that starts a reception process in the position measurement mode (position measurement/reception process), the reception control section 310 detects the operation on the basis of an operation signal outputted from the detection device 170 and activates the position measuring section 312. The position measuring section 312 activates the reception device 45 to start the position measurement/reception process (S11B). When the position measurement/reception process is executed, the reception device 45 executes the process of capturing the GPS satellites 100. The reception device 45 captures at least three, preferably four GPS satellites 100 and receives satellite signals transmitted from the captured GPS satellites 100 to calculate and acquire the position information. The reception device 45 can simultaneously acquire the time information when it receives the satellite signals. It is noted that the position measurement/reception process requires 30 seconds at the shortest before successful reception.

The display control section 320 then causes the indicating hand 21 (second hand) to point the 30-second position, so that start information representing that the reception process has started is displayed (S12B).

The display control section 320 then causes the indicating hand 25 (mode hand) to point the numeral "4+", which indicates that the position measurement/reception process is being executed (S13B).

After the number of captured satellites is acquired in S14, the condition evaluation section 370 evaluates whether or not the number of captured GPS satellites 100 and the strengths of the signals therefrom satisfy the position measurable condition set in advance (S41).

Specifically, the condition evaluation section 370 selects, from the captured GPS satellites 100, four GPS satellites 100 in the descending order of the signal strength. In a case where the number of captured GPS satellites 100 is smaller than or equal to 4, the condition evaluation section 370 selects all the captured GPS satellites 100.

The condition evaluation section 370 then determines the sum of the signal strength values of the signals from the selected GPS satellites 100 and calculates the quotient of the determined sum divided by 4. The condition evaluation section 370 then evaluates whether or not the calculated value is greater than or equal to a strength threshold set in advance, and in a case where the calculated value is greater than or equal to the strength threshold, the condition evaluation section 370 determines that the position measurable condition has been satisfied.

In a case where a result of the evaluation in S41 shows YES, the evaluation section 340B determines that the condition under which the number of captured satellites is displayed is satisfied and advances the process to S18. In S18, the number of captured satellites is displayed. That is, in a case where the number of captured GPS satellites 100 and the strengths of the signals therefrom satisfy the position measurable condition, the number of captured satellites is displayed even before the predetermined period elapses after the start of the reception process. In S16B, the evaluation section 340B evaluates whether or not the position information has been successfully acquired.

In a case where a result of the evaluation in S41 shows NO, it is evaluated in S15 whether or not the predetermined period has elapsed since the reception process started. In a case where a result of the evaluation in S15 shows YES, the evaluation section 340B determines that the condition under which the number of captured satellites is displayed is satisfied and advances the process to S18. In S18, the number of captured satellites is displayed. On the other hand, in a case where a result of the evaluation in S15 shows NO, it is evaluated in S16B whether or not the position information has been successfully acquired.

In the position measurement/reception process, the greater the number of captured satellites, the more likely the successful reception. Displaying the number of captured satellites therefore allows the user to grasp the degree of readiness of successful reception.

In the present embodiment, in the case where the position information is successfully acquired, time zone data is set in accordance with the acquired position information (latitude, longitude). Specifically, time zone data (time difference information) corresponding to the position information is selected and acquired from the time zone data storage section 220 and stored (set) in the first time zone data 216.

The time correction section 350 then corrects the first-display time data 214 by using the first time zone data 216. The first-display time data 214 therefore shows time obtained by adding the time zone data to the internal time data 213, which is UTC.

Advantageous Effects of Third Embodiment

In the case where a certain period has elapsed since the reception process started and it can be decided that the number of captured satellites is correct, the number of captured satellites is allowed to be displayed, whereby the convenience provided by the electronic timepiece can be improved.

Further, even before the predetermined period elapses after the start of the reception process, in the case where it can be decided that the position measurable condition has been satisfied and a successful reception environment has been achieved, the number of captured satellites is displayed, whereby a situation in which a successful reception environment has been achieved can be quickly displayed.

Other Embodiments

The invention is not limited to the embodiments described above, and changes, improvements, and other modifications to the extent that they can achieve the advantage of the invention fall within the scope of the invention.

In each of the embodiments described above, in the time measurement/reception control process and the position measurement/reception control process, after the reception control section 310 activates the reception device 45 to start the reception process, the display control section 320 causes the indicating hand 21 to display the start information, but not necessarily in the invention.

For example, when the display control section 320 detects the reception start operation performed on the operation section on the basis of an operation signal outputted from the detection device 170, the display control section 320 may cause the indicating hand 21 to display the start information, and the activation of the reception device 45 and the display of the start information may be simultaneously performed.

The simultaneous activation of the reception device 45 and display of the start information is intended to achieve a state in which the period during the activation of the reception device 45 and the period during the movement of the indicating hand 21 for display of the start information at least partially overlap with each other.

The action of the electronic timepiece and the timing of the display in this case will be described with reference to the example shown in FIG. 14. The example shown in FIG. 14 is an example of the time measurement/reception process.

Figure 14:
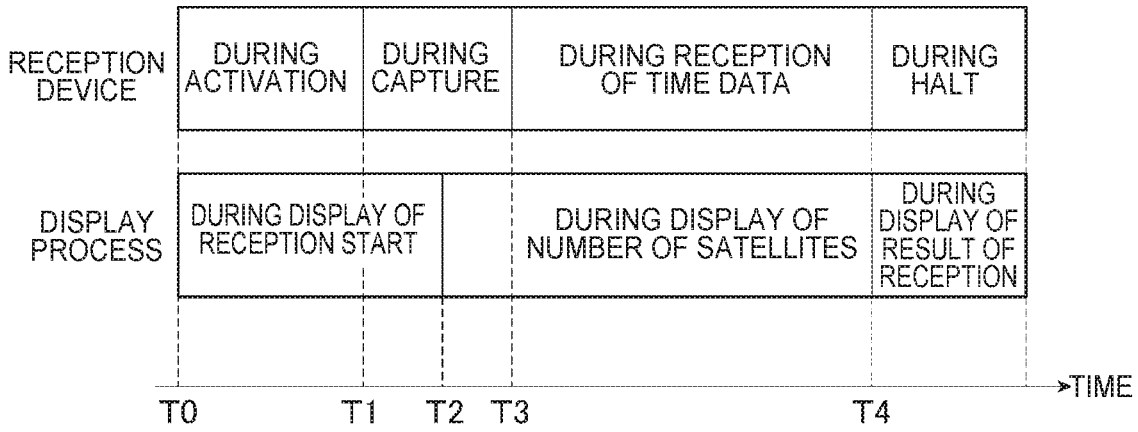
FIG. 14 shows an example of the action of an electronic timepiece and the timing of display in another embodiment of the invention.

In the example shown in FIG. 14, when the A button 2 is pressed to perform the reception start operation, the time measuring section 311 activates the reception device 45 at time T0. Further, the display control section 320 starts moving the indicating hand 21 at the time T0 and causes the indicating hand 21 to point the 0-second position to display the start information.

Thereafter, at time T1, the reception device 45 having been activated executes the process of capturing the GPS satellites 100. At the time T1, the start information is still displayed.

After the predetermined period elapses with no time information acquired and when time T2 is reached, the display control section 320 causes the indicating hand 21 to display the number of captured satellites.

Thereafter, when a GPS satellite 100 that allows acquisition of the time information is captured at time T3, the reception device 45 receives time data from the GPS satellite 100.

When the time information has been successfully acquired at time T4, the reception control section 310 deactivates the reception device 45. Further, the display control section 320 causes the indicating hand 21 to display a result of the reception at the time T4.

The start information can thus be quickly displayed as compared with the case where the indicating hand 21 starts moving to display the start information after the activation of the reception device 45 is completed. Further, the average period from the point of time when the reception start operation is performed to the point of time when the reception process is completed can be shortened as compared with a case where the activation of the reception device 45 starts after the movement of the indicating hand 21 that displays the start information is completed.

In each of the embodiments described above, in the case where the time information or the position information has been successfully acquired, corrected time is displayed after a result of the reception is displayed, but not necessarily in the invention. For example, the display control section 320 may control the indicating hands 21 to 23 and 26 to 28 and the calendar wheel 20 to cause them to display a result of the reception and corrected time at the same time.

The state in which a result of the reception and corrected time are displayed at the same time is a state in which the period for which the indicating hand 21 moves to display a result of the reception and the period for which any of the indicating hands 22, 23, and 26 to 28 and the calendar wheel 20 moves to display corrected time at least partially overlap with each other.

The period before the user can check both a result of the reception and corrected time can therefore be shortened as compared with the case where either the result of the reception or the corrected time is displayed and then the other is displayed.

In each of the embodiments described above, the reception state information displayed during the reception is the number of captured satellites, but not necessarily in the invention. For example, the reception state information may be a reception state level determined on the basis of the number of captured satellites and the strengths of the signals therefrom.

For example, the reception state level is expressed in three levels, 0, 1, and 2, and in the time measurement/reception process, the reception state level is evaluated as follows: That is, in a case where the number of captured satellites is 0, the reception state level is determined to be "0". In a case where the number of captured satellites is at least 1 but the number of captured satellites that each provide a signal strength greater than or equal to a predetermined value is 0, the reception state level is determined to be "1". In a case where the number of captured satellites that each provide a signal strength greater than or equal to the predetermined value is at least 1, the reception state level is determined to be "2".

In the position measurement/reception process, the reception state level is evaluated as follows: That is, in a case where the number of captured satellites is fewer than 4, the reception state level is determined to be "0". In a case where the number of captured satellites is at least 4 but the number of captured satellites that each provide a signal strength greater than or equal to the predetermined value is fewer than 4, the reception state level is determined to be "1". In a case where the number of captured satellites that each provide a signal strength greater than or equal to the predetermined value is at least 4, the reception state level is determined to be "2".

That is, the reception state information only needs to be information on the reception process.

In each of the embodiments described above, when the reception process is completed, the indicating hand 21 displays a result of the reception, but not necessarily in the invention. For example, the indicating hand 21 may display corrected time instead of a result of the reception.

In each of the embodiments described above, the time displayed by the indicating hand that displays the reception state information (indicating hand 21) when the reception is completed is the second of the time, but not necessarily in the invention. For example, the time described above may be the minute, the hour, or the date.

In each of the embodiments described above, the indicating hand that displays the reception state information also displays the start information, the reception state information, a result of the reception, and time, but not necessarily in the invention. For example, the start information, the reception state information, a result of the reception, and time may be displayed by another indicating hand.

The reception state information may still instead be displayed by a digital display device, such as a liquid crystal display device.

In the third embodiment described above, the evaluation section 340B determines that the condition under which the number of captured satellites is displayed is satisfied when the predetermined period has elapsed with acquisition of no position information since the reception process started and when the position measurable condition is satisfied, but not necessarily in the invention. For example, the evaluation section 340B may determine that the display condition is satisfied only when the predetermined period has elapsed with acquisition of no position information.

In each of the embodiments described above, the manual reception process in which the reception process is executed in response to the reception start operation performed by the A button 2 has been described as an example of the reception process, but not necessarily in the invention. For example, the reception process can instead be an automatic reception process automatically executed, for example, when time set in advance is reached or when the illuminance of the light with which the solar panel 135 is irradiated is greater than or equal to an illuminance threshold so that it can be determined that the electronic timepiece is located outdoor.

In each of the embodiments described above, the reception control section 310 includes the time measuring section 311 and the position measuring section 312, but not necessarily in the invention. For example, the reception control section 310 may include only one of the time measuring section 311 and the position measuring section 312.

In each of the embodiments described above, the GPS satellites 100 have been described as an example of the position information satellite, but not necessarily in the invention. For example, the position information satellite can, for example, be any of the satellites used in GALILEO (EU), GLONASS (Russia), BeiDou (China), and other global navigation satellite systems (GNSS). Further, a stationary satellite such as a satellite used in a satellite-based augmentation system (SBAS), a quasi-zenith satellite, such as a satellite used in a global satellite positioning system (RNSS) that allows search only in a specific area, and any other satellite can be used.

In the first and second embodiments described above, a satellite signal has been described as an example of the electric wave received by the reception device in the time measurement mode, but not necessarily in the invention. For example, as the electric wave, an electric wave containing time information, such as the standard electric wave, can also be used.

The entire disclosure of Japanese Patent Application No. 2016-241311, filed Dec. 13, 2016 is expressly incorporated by reference herein.

What is claimed is:

1. An electronic timepiece comprising:

a reception device that receives an electric wave;

a reception control section that executes a reception process of controlling the reception device to cause the reception device to receive the electric wave and acquiring time information based on a received signal;

an acquisition section that acquires reception state information on a reception state of the electric wave;

an indicating hand capable of displaying the reception state information and predetermined information set in advance;

a display control section that controls display performed by the indicating hand; and an evaluation section that evaluates whether or not a state of the reception process satisfies a preset condition under which the reception state information is displayed, wherein the display control section causes the indicating hand to display the reception state information when the display condition is satisfied during the execution of the reception process, causes the indicating hand to display the predetermined information when the reception process is completed, and in a case where the reception process is completed without the display condition being satisfied, the reception state information is not displayed on the display section and the display control section causes the indicating hand to display the predetermined information when the reception process is completed.

2. The electronic timepiece according to claim 1, wherein the evaluation section determines that the display condition is satisfied when a predetermined period set in advance has elapsed with no acquisition of the time information since the reception process started.

3. The electronic timepiece according to claim 1, further comprising a success chance evaluation section that evaluates whether or not there is a chance of successful reception based on the state of the reception process, wherein the evaluation section determines that the display condition has been satisfied when it has been determined that there is no chance of successful reception.

4. The electronic timepiece according to claim 1, further comprising:

a start information displaying indicating hand capable of displaying start information representing that the reception process starts; and an operation section, wherein the reception control section, upon detection of reception start operation performed on the operation section, activates the reception device to start the reception process, the display control section, upon detection of the reception start operation performed on the operation section, causes the start information displaying indicating hand to display the start information, and the activation of the reception device and the display of the start information are simultaneously performed.

5. The electronic timepiece according to claim 1, further comprising:

a reception result displaying indicating hand capable of displaying a result of the reception;

a time displaying indicating hand capable of displaying time; and a time correction section that corrects the time based on information acquired in the reception process, wherein the display control section controls the reception result displaying indicating hand and the time displaying indicating hand to cause the indicating hands to simultaneously display the result of the reception and the corrected time in a case where the information has been successfully acquired in the reception process.

6. The electronic timepiece according to claim 5, wherein the reception result displaying indicating hand is a longest indicating hand of the indicating hands provided in the electronic timepiece.

7. The electronic timepiece according to claim 6, wherein the indicating hand indicates that the reception process is being executed until the reception state information is displayed after the start of the reception process.

8. The electronic timepiece according to claim 6, wherein the indicating hand is a second hand.

9. An electronic timepiece comprising:

a reception device that receives a satellite signal transmitted from a position information satellite;

a reception control section that executes a reception process of controlling the reception device to cause the reception device to receive the satellite signal, calculating position information based on a received signal, and acquiring the position information;

an acquisition section that acquires reception state information on a reception state of the satellite signal;

a display section capable of displaying the reception state information;

a display control section that controls display performed by the display section; and an evaluation section that evaluates whether or not a state of the reception process satisfies a preset condition under which the reception state information is displayed, wherein the evaluation section determines that the display condition is satisfied when a predetermined period set in advance has elapsed with no acquisition of the position information since the reception process started, the display control section causes the display section to display the reception state information when the display condition is satisfied during the execution of the reception process, and the display control section does not cause the display section to display the reception state information during the execution of the reception process in a case where the reception process is completed without the display condition being satisfied.

10. The electronic timepiece according to claim 9, further comprising a condition evaluation section that evaluates whether or not a number of position information satellites captured in the reception process and a signal strength of a signal from each of the captured position information satellites satisfy a position measurable condition set in advance, and the evaluation section determines that the display condition has been satisfied when the position measurable condition has been satisfied.

11. The electronic timepiece according to claim 9, further comprising:

a start information displaying indicating hand capable of displaying start information representing that the reception process starts; and an operation section, wherein the reception control section, upon detection of reception start operation performed on the operation section, activates the reception device to start the reception process, the display control section, upon detection of the reception start operation performed on the operation section, causes the start information displaying indicating hand to display the start information, and the activation of the reception device and the display of the start information are simultaneously performed.

12. The electronic timepiece according to claim 9, further comprising:

a reception result displaying indicating hand capable of displaying a result of the reception;

a time displaying indicating hand capable of displaying time; and a time correction section that corrects the time based on information acquired in the reception process, wherein the display control section controls the reception result displaying indicating hand and the time displaying indicating hand to cause the indicating hands to simultaneously display the result of the reception and the corrected time in a case where the information has been successfully acquired in the reception process.

13. The electronic timepiece according to claim 12, wherein the reception result displaying indicating hand is a longest indicating hand of the indicating hands provided in the electronic timepiece.

14. The electronic timepiece according to claim 12, wherein the display section includes an indicating hand that displays the reception state information.

15. An electronic timepiece comprising:

a reception device that receives a satellite signal;

a reception control section that executes a reception process of calculating time information or information on a position of a current location based on the received satellite signal and acquiring the information; and a display section capable of displaying reception state information based on a strength of the received satellite signal or a number of captured satellites during the execution of the reception process, wherein in a case where a predetermined period has elapsed with no acquisition of the time information or the position information since the reception process started, the reception state information is displayed on the display section, and in a case where the time information or the position information has been successfully acquired within the predetermined period since the reception process started, the reception state information is not displayed on the display section but the reception process is terminated.

* * * * *